United States Patent [19]

Eisenberg

[11] 4,349,053

[45] Sep. 14, 1982

[54] METHOD AND APPARATUS FOR FILLING CONTAINERS WITH LIQUID

[75] Inventor: Bernard C. Eisenberg, Rockaway, N.J.

[73] Assignee: Solbern Corp., Fairfield, N.J.

[21] Appl. No.: 127,530

[22] Filed: Mar. 5, 1980

[51] Int. Cl.[3] ..... B65B 3/06; B65B 43/54

[52] U.S. Cl. ..... 141/1; 141/133; 141/135; 141/171

[58] Field of Search ..... 141/1, 131–135, 141/164, 177, 171, 324

[56] References Cited

U.S. PATENT DOCUMENTS

| | | | |
|---|---|---|---|
| 2,951,514 | 9/1960 | Flack | 141/132 |
| 3,228,434 | 1/1966 | Johnson et al. | 141/132 |
| 4,103,720 | 8/1978 | Eisenberg | 141/131 X |

*Primary Examiner*—Frederick R. Schmidt
*Attorney, Agent, or Firm*—Kenyon & Kenyon

[57] ABSTRACT

Equally spaced pusher bars moving continuously around a closed path individually engage open top containers and push them in single file through a filling region where they are filled with liquid flowing freely in a continuous sheet from an elongated discharge edge extending along the path above the open tops of the containers. A separate deflecting unit is adjustably attached to each pusher bar, each deflecting unit having an upwardly convex wedge-shaped deflecting surface. The deflecting units move with the containers through the filling region, and the deflecting surfaces divide the continuous sheet of flowing liquid into a number of separate streams directed into the interiors of the respective containers, thereby preventing the liquid from contacting the external surfaces of the containers.

12 Claims, 4 Drawing Figures

METHOD AND APPARATUS FOR FILLING CONTAINERS WITH LIQUID

BACKGROUND OF THE INVENTION

1. Field of the Invention

The invention relates to a method and apparatus for filling a line of moving containers with liquid and particularly to a method and apparatus for filling continuously moving containers from a continuously flowing source to a common predetermined level while avoiding spillage of the liquid onto the exterior surfaces of the containers.

2. Description of the Prior Art

U.S. Pat. No. 4,103,720, issued to the present applicant on Aug. 1, 1978, describes a method and apparatus for filling open-top containers with liquid material. The containers are advanced continuously in a line along a predetermined path through a filling region where liquid material is discharged from a reservoir in a continuous sheet over an inclined plate, the lower edge of which extends in the direction of advance above the open tops of the line of containers. In the filling region, the containers are tilted transversely to the path at a predetermined angle with respect to the vertical, and the flow rate of the liquid is adjusted so that each container is overfilled as it passes through the filling region.

To prevent the liquid stream from contacting the external surface of the containers, thus avoiding an extra cleanup step after filling, streams of air are directed towards the tilted containers transversely to the line of advance below their tops, so that the air passes around the peripheries of the containers adjacent to their tops. The air flow laterally deflects any part of the sheet of liquid which would otherwise flow between adjacent containers and also deflects the liquid overflowing from the lower part of the open top of each tilted container away from the side of the container. The deflected liquid falls into a trough below the line of containers and is recirculated from the trough back to the reservoir.

The apparatus of the applicant's U.S. Pat. No. 4,103,720 requires a relatively high volume flow from a source of compressed air for deflecting the liquid flow away from the exterior surfaces of the containers. Such a source is not always available.

Other systems are known which mechanically deflect fluent materials being discharged from a fixed spout into a line of continuously moving receptacles to prevent material falling between adjacent receptacles. For example, U.S. Pat. No. 2,785,707 to J. F. Ryan, Jr. et al. discloses apparatus for filling containers such as flanged cans or jars moving in a line under a spout continuously discharging a stream of liqui-form product. A cam-driven, pivotally mounted wedge-shaped deflector oscillates under the spout in synchronism with the movement of the containers. In its forward direction of movement it covers the gap between adjacent containers when the gap moves under the stream of material. The drive cam has a quick-return sector which then sends the deflector back through the stream to be in position to cover the succeeding gap as it arrives underneath the spout.

In U.S. Pat. No. 3,228,434 of K. R. Johnson et al. fluent materials are discharged continuously from a spout into a line of moving receptacles through rectangular funnels mounted on an elongated endless carrier which moves in synchronism with the receptacles.

Johnson et al, also use a wedge-shaped deflector to cover the gap between adjacent funnels as the gap passes underneath the spout, but instead of a single oscillator, they provide individual dividers mounted between adjacent funnels in a manner to accommodate relative movement of the latter as the funnels pass around the arcuate end portions of the carrier path.

U.S. Pat. No. 3,369,577 discloses similar filling apparatus except that a number of deflectors or dividers are equally spaced around the periphery of a separate rigid support member which is mounted for rotation about a vertical axis. The circumferential spacing of the dividers is equal to the distance between corresponding parts of adjacent funnels, and the divider support rotates in synchronism with the funnel carrier, so that as successive dividers pass under the spout they are positioned directly above the gap between adjacent funnels.

Another example of filling apparatus which uses moving funnels to distribute fluent material into a line of moving receptacles is shown in U.S. Pat. No. 2,951,514 of W. E. Flack. In the Flack apparatus granular material flows over an inclined plate, the lower edge of which is positioned over a rotatable circular trough. The bottom of the trough is subdivided circumferentially into corresponding receptacles, the funnels and receptacles moving in a circular path under the edge of the inclined plate.

Further examples of filling apparatus of this general class are disclosed in U.S. Pat. Nos. 3,152,622 of O. Rothermel; 3,057,382 of D. B. Baker; 3,087,652 of H. L. Smith, Jr.; 4,010,594 of J. L. Boyd et al.; and 2,058,976 of H. E. Gray.

Except for the applicant's U.S. Pat. No. 4,103,720 and the Ryan U.S. Pat. No. 2,785,707, all of the above-mentioned patents are concerned with filling containers with dry products. Preventing contact by a flowing liquid product with the outer surfaces of the containers presents greater problems because of the tendency of liquid to splash, particularly at high flow velocities. Thus, the spout-type filling machines, which have a fixed discharge cross section, are not well suited for machines intended to deliver a wide range of filling rates to containers of different sizes.

Liquid products, particularly liquid food products, also present a more difficult clean up problem; so it is desirable to minimize the number and complexity of parts which convey the liquid product to the final containers.

SUMMARY OF THE INVENTION

It is the principal object of the present invention to provide an apparatus and method for filling a continuously moving line of containers to a predetermined level in a filling region with liquid continuously flowing in a sheet over a surface having an elongated discharge edge, in which the flowing sheet is divided into separated, spaced-apart streams aligned with the openings of the containers and moving in synchronism with them through the filling region, so that the liquid product will not contact the outer surfaces of the containers.

A further object of the invention is to provide an apparatus for filling containers with liquid which is capable of accommodating a wide range of container sizes and filling rates with minimal changes and adjustments.

These and other objects are achieved in the method and apparatus of the invention for filling open-top containers with liquid, the method including advancing a line of open top containers along a predetermined path through a filling region and discharging a liquid material in a substantially continuous sheet over a surface having an elongated discharge edge extending through the filling region above the open tops of the containers in the direction of said predetermined path, characterized by dividing said substantially continuous sheet of flowing liquid into a plurality of separate equally spaced streams aligned with the open tops of corresponding containers in the line of containers advancing through the filling region, and moving said divided streams continuously in the direction of the predetermined path in synchronism with the advance of the corresponding containers through the filling region, thereby preventing the liquid material from contacting the outside surfaces of the containers during the filling thereof.

The invention further includes apparatus specifically designed for carrying out the above method, the apparatus including means for advancing a line of open top containers along a predetermined path through a filling region; a surface having an elongated discharge edge extending through the filling region above the open tops of the containers in the direction of said predetermined path; and means for discharging a liquid material in a substantially continuous sheet over the discharge edge of said surface, characterized by a plurality of spaced apart deflecting members positioned to extend transversely through said continuous sheet of liquid for dividing said sheet into a plurality of separate equally spaced streams aligned with the open tops of corresponding containers in the line of containers advancing through the filling region, and means for continuously moving said deflecting members in a closed path in synchronism with the advancement of the line of containers through the filling region such that the liquid discharged over said discharge edge does not contact the outside surfaces of the containers.

Additional features and advantages of the invention will become apparent from the following description of the preferred embodiment as illustrated in the accompanying figures.

BRIEF DESCRIPTION OF THE DRAWINGS

FIG. 3 is a partial view in section of the apparatus of FIG. 1 looking in the direction of advance of the containers through the filling region.

DESCRIPTION OF THE PREFERRED EMBODIMENT

Figure 1:
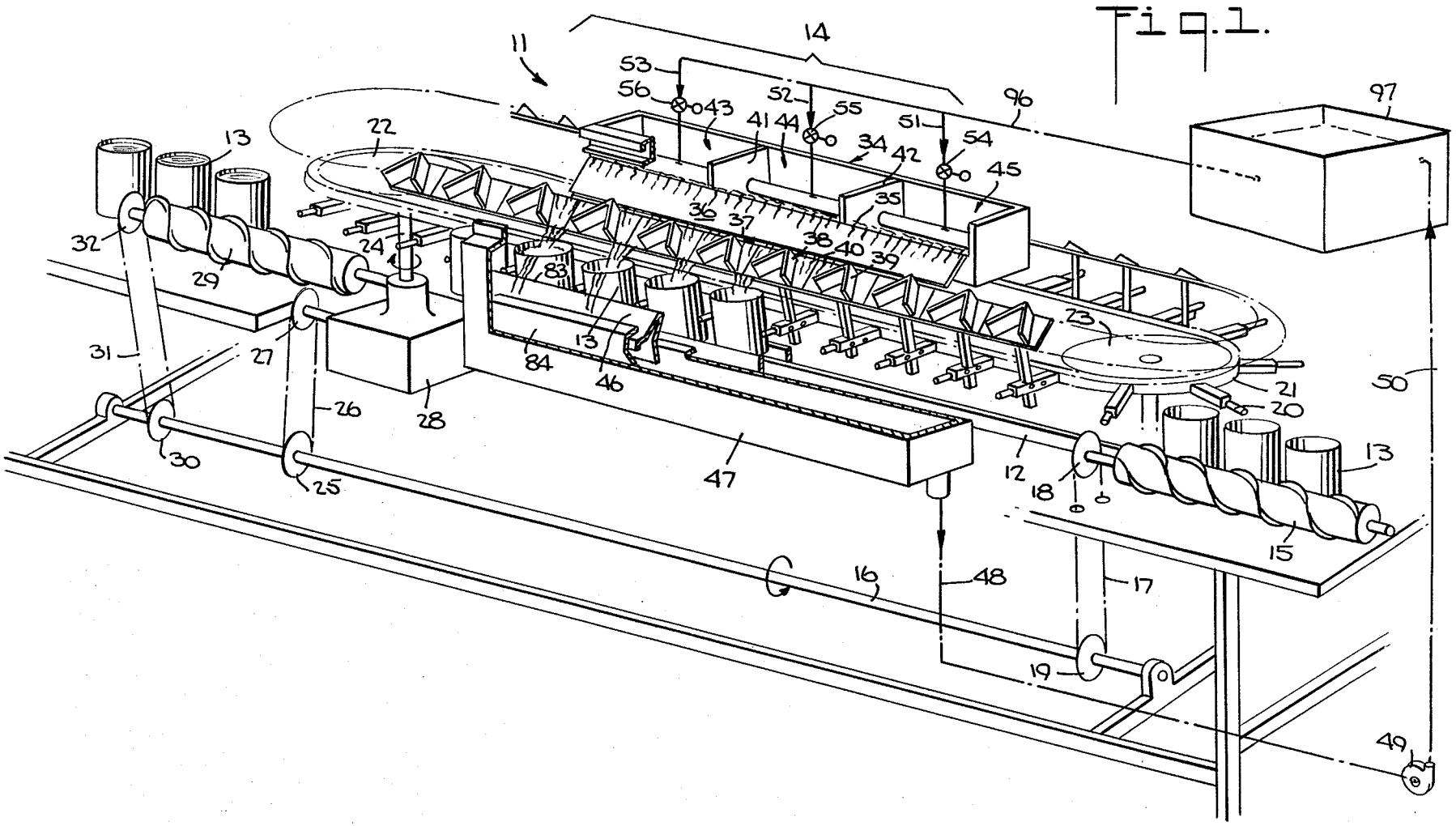
FIG. 1 is a perspective view, partly cut away and in schematic form, of the preferred embodiment of an apparatus for filling containers with liquid according to the invention.
Figure 2:
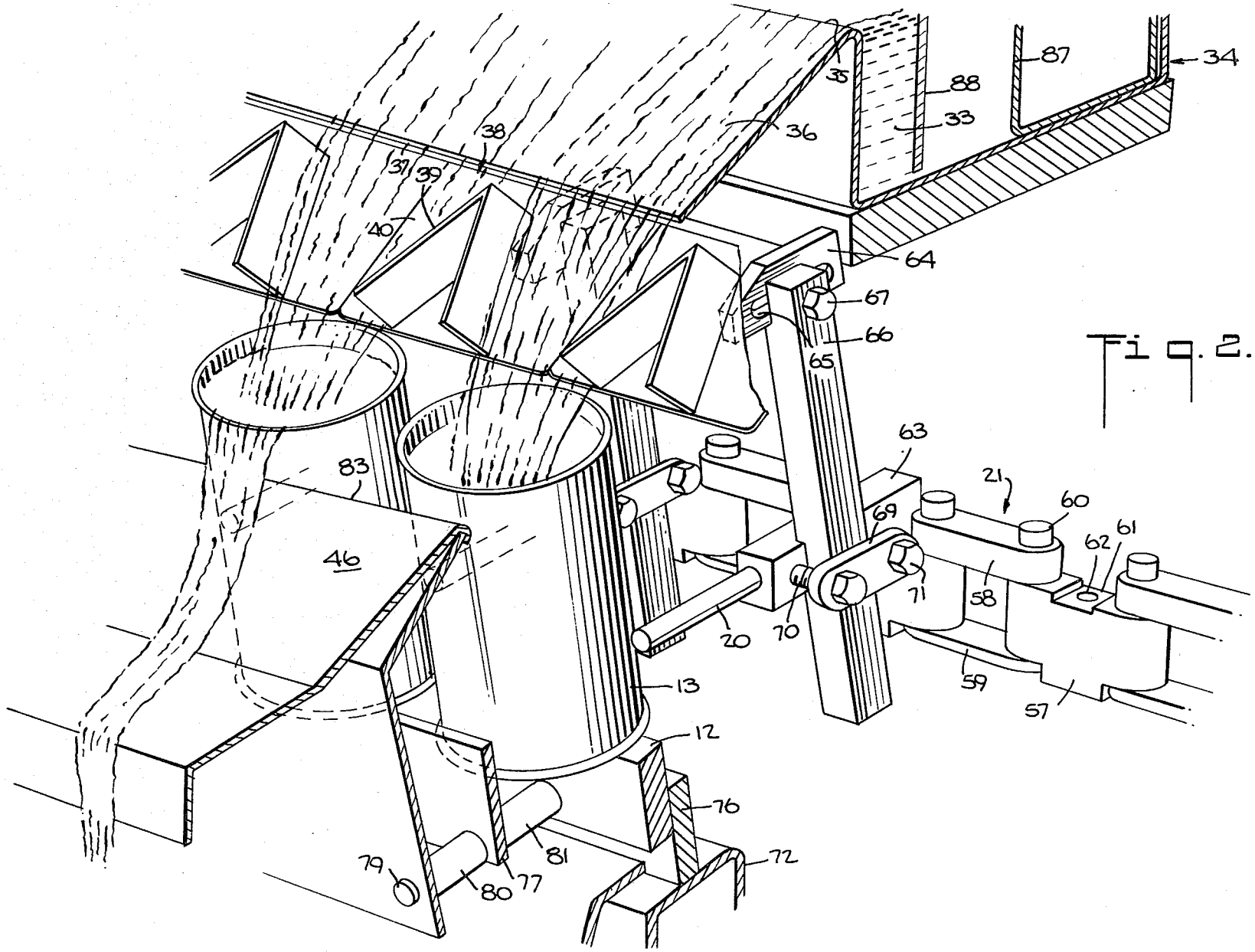
FIG. 2 is a partial cut away closeup view of a portion of the filling region of the apparatus in FIG. 1.
Figure 5:
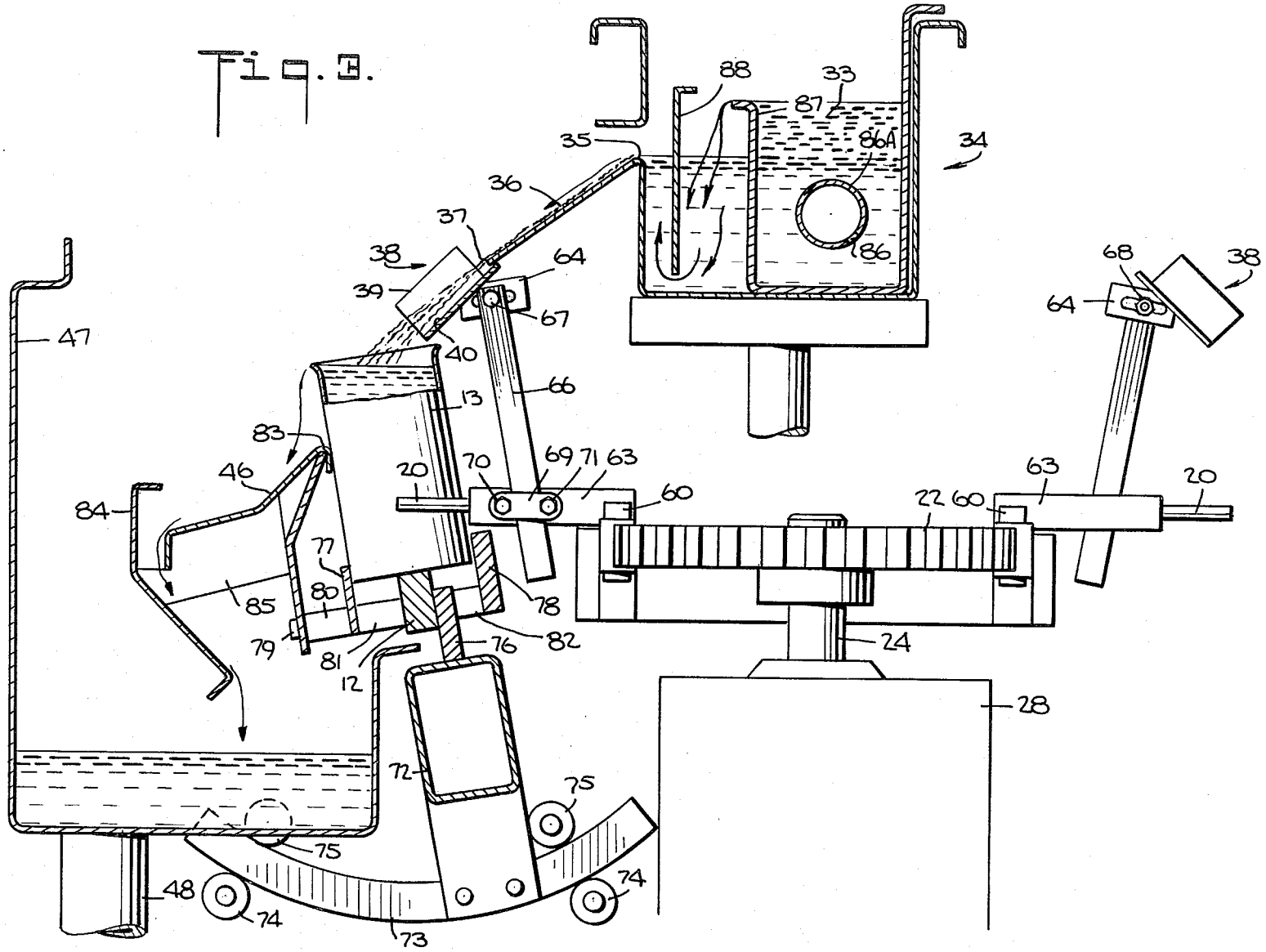

With reference to the figures, in which FIG. 1 shows an overall view in partly cutaway schematic form of the preferred embodiment of the invention and FIGS. 2 and 3 supply closeup detailed views, a machine 11 for filling containers with liquid includes a support bar 12 which defines the longitudinal axis of the machine and provides support for a line of containers 13 advancing through a filling region or station 14.

The containers enter the machine at the right hand side of the drawing and are advanced toward the filling region by a conventional screw-type feeder 15 which is driven from a main drive shaft 16 through a belt 17 and pulleys 18 and 19, or equivalent drive means such as a chain and sprocket wheels. Drive shaft 16 itself may be rotated in the direction indicated by the arrow by any suitable means such as a variable speed electric motor (not shown).

As each container leaves screw feeder 15, it is engaged by one of a plurality of pusher bars 20 mounted in equally spaced relation on an endless carrier 21, which describes an elongated closed path around a drive wheel 22 and a driven or idler wheel 23 positioned at opposite ends of the machine. Drive wheel 22 is mounted on a vertical shaft 24 and is driven by main drive shaft 16 through pulley 25, belt 26, pulley 27, and angle gear unit 28 or by a chain and sprockets.

Shaft 24 rotates in the direction of the arrow so that carrier 21 advances from right to left along a line adjacent to the path of the containers through the filling region. The pusher bars 20 are spaced apart on carrier 21 to correspond to the pitch of screw feeder 15, which delivers a container once per revolution. Since both screw feeder 15 and carrier 21 are driven from the same drive shaft 16, their movement is synchronized to deliver a container at the exit of feeder 15 each time a pusher bar comes around the idler wheel 23.

At the exit end of the filling region 14 a second screw-type feeder 29 engages each container as the carrier 21 moves away from the feed path around drive wheel 22 to start the return leg of its closed path. Second feeder 29 also is driven in synchronism with carrier 21 from drive shaft 16 by means of pulley 30, belt 31, an pulley 32, or by a chain and sprockets. Screw feeder 29 delivers the filled containers 13 to any suitable conveyor (not shown) for the next operation, such as closing the tops of the containers.

As the containers are advanced by the pusher bars through the filling region, they are tilted to a predetermined angle transverse to their line of travel, by means to be described below, and they are filled with a liquid product 33 delivered continuously from a supply tank or reservoir 34 (FIG. 3). One side of tank 34 is bent down to form a weir 35 and a downwardly inclined plate 36 which has a discharge edge 37 positioned above the open tops of the line of containers along their path of advance.

The liquid product flows over the weir and down the inclined plate to be discharged in a substantially continuous sheet from edge 37. If it were allowed to flow directly into the containers, it would contact the exterior surfaces and the lips of the open tops. In the case of most liquid products, this would require extra cleaning and drying steps before the tops of the containers could be sealed. To avoid this problem, a plurality of deflecting members 38 are mounted, one on each pusher bar 20 by means described below, to bridge the space between adjacent containers and thereby to divide the continuous sheet of liquid into separate, spaced-apart streams, each of which is aligned with the open top of a corresponding container (FIG. 2).

Each deflecting member 38 includes an upwardly convex surface, such as wedge-shaped member 39, which may be simply a piece of sheet metal bent into an inverted V shape. Preferably, each wedge-shaped member 39 is mounted on a backing plate 40 which serves as a means for mounting the wedge-shaped member and also as a shield for any liquid which may flow to the rear edge of the wedge-shaped member. As is described more fully below, however, the deflecting member is positioned so that backing plate 40 is behind and below the trajectory of the liquid film discharged from plate 36, so ordinarily backing plate 40 will not be contacted by any liquid except at the corners where the backing plate meets the wedge surfaces.

The supply tank 34 extends for the entire length of the filling region, and in the preferred embodiment it is sub-divided by transverse partitions 41 and 42 into three separate compartments 43, 44, and 45. Depending on the size and rate of advance of the containers, fresh liquid product can be supplied continuously through a conduit 96 from a reservoir 97 to only one of the compartments, or two or three, to assure that there is sufficient volume of flow to at least slightly overfill each container while keeping the flow velocity low enough to avoid splashing but high enough to avoid contact with the backing plates 40.

As shown in FIG. 1, at the left end of the filling region the containers are filled to overflowing, and the excess liquid flows from the lower edges of the open tops of the tilted containers over a guide plate 46 and into an overflow trough 47. From trough 47 the overflow liquid is returned to supply tank 33 by a system illustrated schematically by a conduit 48, a pump 49, a conduit 50, reservoir 97, conduit 96, and branch lines 51, 52, and 53 leading respectively to compartments 43, 44, and 45. Each branch line can be selectively opened or shut by a corresponding valve 54, 55, or 56.

With reference particularly to FIGS. 2 and 3, which illustrate further details of the preferred embodiment, carrier 21 comprises a plurality of support members 57 connected by upper links 58 and lower links 59 which are pivotally attached to the support members by pins or bolts 60. The top of each support member 57 has a transverse slot 61 and is drilled with a hole 62 to carry a rectangular end 63 of a pusher bar 20, so that the pusher bar is supported rigidly to extend outward substantially perpendicular to the supporting member.

As mentioned earlier, each deflecting member 38 is mounted on a corresponding pusher bar, the mounting assembly including a slotted bar 64 which is welded or otherwise secured to the deflecting member and is fastened through its slot 65, for slidable and rotatable adjustment, to the upper end of a support rod 66 by a bolt 67 and a nut 68. Support rod 66 in turn is clamped to the rectangular end 63 of pusher bar 20 by a cross-piece 69 and two bolts 70 and 71, this arrangement permitting slidable adjustment of the height of the deflecting member. Thus, the assembly for mounting each deflecting member on its corresponding pusher arm permits a wide range of lateral, vertical, and angular adjustments to accommodate a large variation in container sizes and shapes.

As shown by the flow lines in FIG. 3, the deflecting member is positioned so that the trajectory of the sheet of liquid discharged over the edge of inclined plate 36 coincides approximately with a plane midway between the front and rear edges of each wedge face. In this way, almost no liquid will contact the backing plates 40 except for a small amount which may spread across the wedge surfaces and flow down the "gutter" at the intersection of each wedge surface with the adjacent backing plate. Consequently, there is no need for a close fit between the adjacent edges of the backing plates of consecutive deflecting members. If desired, the front edges of each wedge surface can be turned to form a flange or lip (not shown) to prevent liquid flowing over the front edges of the wedge member.

The previously mentioned means for tilting the containers to a predetermined angle, which angle depends upon the amount of headspace desired in the filled container, includes a hollow rigid support beam 72 of rectangular cross section extending under and parallel to the path of the advancing containers. Beam 72 is mounted on at least two arcuate bars 73 (only one shown in FIG. 3) which are supported by pairs of bottom rollers 74 and top rollers 75, mounted on the frame of the machine by any suitable means (not shown). A solid mounting bar or rib 76 of rectangular cross section is welded along the length of the top of beam 72. Mounting rib 76 in turn carries support bar 12, guide plate 46, and side rails 77 and 78, all attached to rib 76 by longitudinally spaced bolts 79 and separated from each other by suitable spacers 80, 81, and 82. This arrangement permits easy and quick disassembly to substitute different spacers for different container sizes.

The curvature of arcuate bars 73 is selected to be approximately concentric with the top of support bar 12, thereby providing angular adjustment of the entire container support assembly on the rollers 74, 75. The assembly can be locked at any desired tilt angle within its limits of adjustment by suitable clamping means (not shown).

It will be noted from FIG. 3 that guide plate 46 serves the dual functions of supporting the sides of the containers on its edge 83 and also of shielding the sides of the containers from any splashback of the overflowing liquid product. In addition, guide plate 46 supports a baffle 84 by means of a bracket 85 to guide the overflow liquid into trough 47 without any splashing up against the containers.

FIG. 3 also illustrates the preferred structure inside each compartment of reservoir 33 for minimizing surging and splashing to provide a smooth even flow of liquid product over the weir. To this end, fresh and recirculated liquid product is introduced into each compartment of the supply tank through holes 86A in headers 86 positioned in a baffle 87 which suppresses eddies and splashing. Finally, a longitudinal upright baffle 88, spaced slightly from the weir and extending down to leave only a small clearance at the bottom of the tank, prevents any lateral surging or liquid splashing in the main part of the tank from disturbing the smooth flow over the weir.

Figure 4:
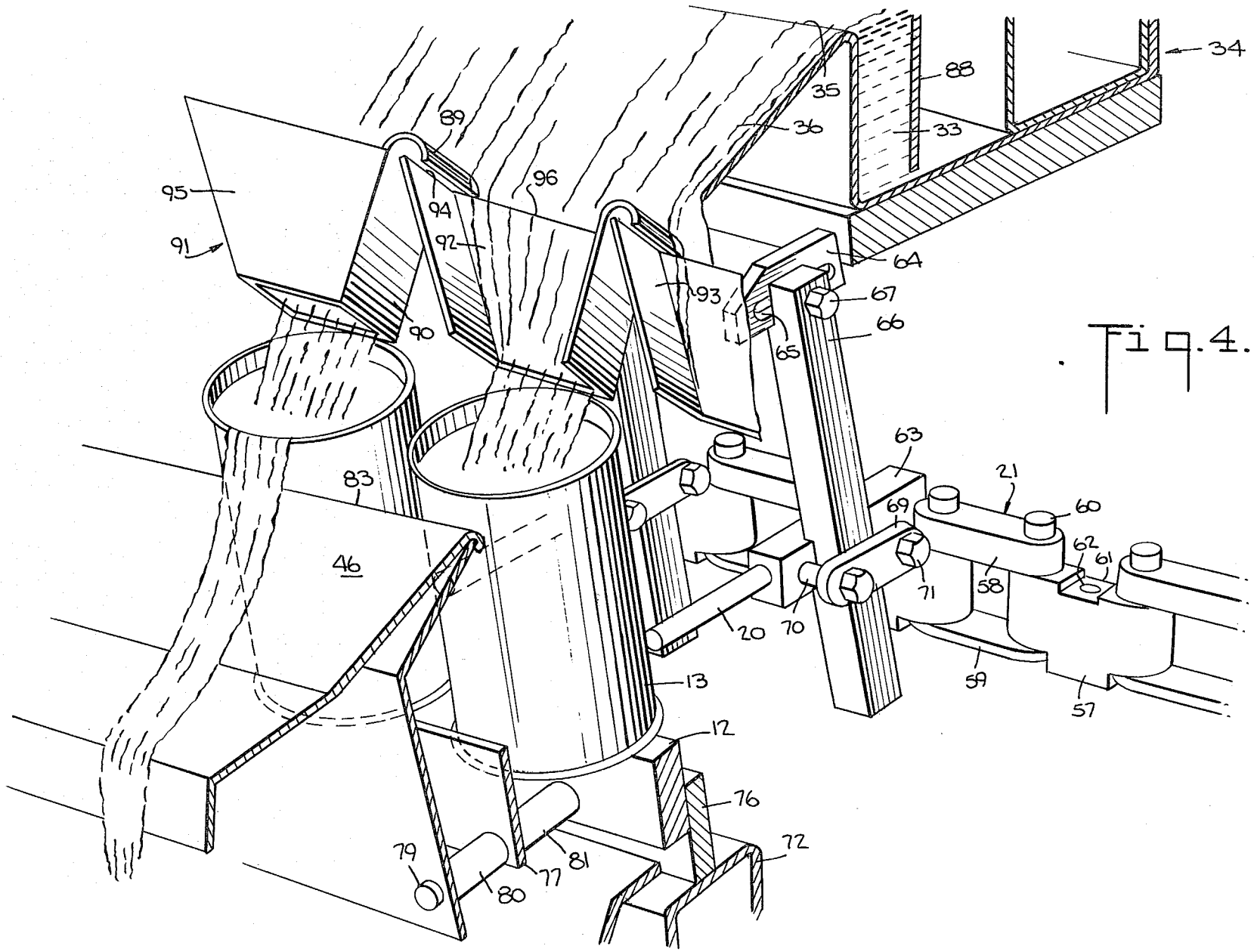
FIG. 4 is a partial cut away closeup view of an alternative embodiment of the apparatus.

FIG. 4 shows an alternative embodiment of the deflecting means of the invention. In this embodiment, a deflecting member 89 is formed as an upwardly convex lip on a trailing lateral wall 90 of each one of a plurality of guide chutes or funnels 91. Each chute has a longitudinal or back wall 92 and a leading lateral wall 93, such that the two lateral walls and the ball wall form a converging trough, and the upper edge 94 of each leading lateral wall is disposed underneath the deflecting lip 89 of the preceding guide chute as the chute progress through the filling region. A front longitudinal wall 95 may be included to make each guide chute in the form of an enclosed funnel, but this is not essential.

It is apparent by comparing FIG. 3 with FIG. 4 that the latter embodiment essentially separates the walls of the deflecting members of FIG. 3, so that the gap between units is covered by the "umbrella" of each deflecting lip 89. This embodiment is particularly useful for filling situations in which the trajectory of the liquid sheet flowing over the discharge edge 37 cannot be conveniently controlled to avoid leaking through the gaps between deflecting units of the former embodiment.

A particular feature of the guide chute or funnel embodiment of FIG. 4 is that the leading lateral wall 93 of each unit is inclined in the forward direction, preferably making an angle of roughly 60° with the horizontal upper edge 96 of the corresponding back wall 92. On the other hand, each trailing lateral wall 90 is substantially perpendicular to edge 96. This arrangement results in much smoother flow into each chute or funnel than if each lateral wall makes the same angle with the upper edge of the back wall. In particular, if the trailing lateral wall slopes forward and downward, the liquid tends to "climb up" this wall, causing splashing.

From the foregoing description it will be readily apparent that the present invention provides an effective method and simple apparatus for filling a continuously moving line of containers with a liquid product flowing in a continuous sheet over a discharge edge extending above the containers without allowing the liquid product to contact any exterior surface of the container. A single conveyor moves the deflecting members and pushes the containers so that the deflecting members are always properly positioned between the containers. The machine can be easily adjusted for different filling rates (containers per minute) by changing conveyor speed and liquid flow rate over the weir.

It will be further apparent to those of skill in the art that the specific arrangement of parts of support assemblies, drive means, and other elements of the described embodiment can be replaced by known equivalent means within the scope of the inventive combination, as claimed below.

What is claimed is:

1. A method for filling open top containers with a liquid material, the method including advancing a line of tilted open top containers along a predetermined substantially straight path through a filling region and discharging a liquid material in a substantially uniform continuous sheet of unsupported flowing liquid from an elongated substantially straight discharge edge extending through the filling region in the direction of said predetermined path at a level spaced above the open tops of the containers, the method being characterized by dividing said substantially continuous sheet of unsupported flowing liquid in the space between the discharge edge and the open tops of the containers into a plurality of separate equally spaced downwardly converging streams aligned with the open tops of corresponding containers in the line of containers advancing through the filling region by providing a plurality of spaced deflectors, disposed in a line under the elongated discharge edge and above the open tops of the containers, each of the deflectors having surfaces facing opposite one another, diverging downwardly, and intersecting the sheet of liquid with the highest point of each deflector being aligned approximately with the region between respective adjacent containers in the line of containers, each downwardly converging stream engaging oppositely disposed diverging surfaces of adjacent deflectors, moving said divided streams continuously in the direction of the predetermined path in synchronism with the advance of the corresponding containers through the filling region by moving said deflectors along said predetermined path in synchronism with the advance of the containers through the filling region, thereby preventing the liquid material from contacting the outside surfaces of the containers during the filling thereof, and adjusting the discharging of liquid material in the sheet in relation to the rate of advance of the containers and the length of the discharge edge to assure overfilling of each tilted container.

2. A method for filling open top containers with a liquid material, the method including advancing a line of tilted open top containers having a predetermined interval between corresponding portions of adjacent containers along a predetermined substantially straight path through a filling region and discharging a liquid material in a substantially continuous sheet of unsupported flowing liquid from an elongated discharge edge extending through the filling region in the direction of said predetermined path at a level spaced above the open tops of the containers, the method being characterized by disposing a plurality of elements at a plurality of locations in said sheet of liquid spaced from one another in the direction of the predetermined path of the containers at a distance corresponding to the predetermined interval between corresponding portions of adjacent containers to divide said substantially continuous sheet of unsupported flowing liquid in the space between the discharge edge and the open tops of the containers into a plurality of separate equally spaced streams aligned with the open tops of corresponding containers in the line of containers advancing through the filling region, transporting the plurality of spaced elements in the direction of the predetermined path of the containers to move said divided streams continuously in the direction of the predetermined path in synchronism with the advance of the corresponding containers through the filling region, thereby preventing the liquid material from contacting the outside surfaces of the containers during the filling thereof, and adjusting the flow of liquid in relation to the rate of advance of the containers and the length of the discharge edge to assure overfilling to each tilted container.

3. Apparatus for filling open top containers with liquid, the apparatus including means for advancing a line of tilted open top containers along a predetermined substantially straight path through a filling region; a surface having an elongated discharge edge extending through the filling region above the open tops of the containers in the direction of said predetermined path; and means for discharging a liquid material in a substantially continuous unsupported sheet from the discharge edge of said surface, characterized by a plurality of spaced-apart deflecting members positioned to extend transversely through said continuous sheet of liquid for dividing said sheet into a plurality of separate equally spaced downwardly converging streams aligned with the open tops of corresponding containers in the line of containers advancing through the filling region, each deflecting member having surfaces facing opposite one another, diverging downwardly, and intersecting the sheet of liquid with the highest point of each deflector being aligned approximately with the region between respective adjacent containers in the line of containers, each downwardly converging stream engaging oppositely disposed converging deflector surfaces of adjacent deflector members, and means for continuously moving said deflecting members in a closed path in synchronism with the advancement of the line of containers through the filling region such that the liquid discharged over said discharge edge does not contact the outside surfaces of the containers.

4. The apparatus of claim 3 wherein each deflecting member comprises a rectangular plate folded in the form of an inverted V.

5. The apparatus of claim 4 wherein each deflecting member further comprises a flat backing plate, and one folded edge of said folded rectangular plate is sealingly attached to said flat backing plate.

6. The apparatus of claim 5 wherein each deflecting member is adjusted so that a plane midway between the folded edges of the folded rectangular plate coincides approximately with the trajectory of the unsupported sheet of flowing liquid.

7. The apparatus of claim 3 wherein the means for advancing the line of open-top containers through the filling region comprises an endless flexible carrier, means for driving the carrier in an elongated closed path, and means attached to the carrier in equally spaced relation and extending laterally therefrom for engaging respective ones of the containers in the line to advance them through the filling region.

8. The apparatus of claim 7 wherein the means for moving said deflecting members in a closed path in synchronism with the advancement of the line of containers comprises means for mounting each deflecting member on a respective one of the means for engaging each container, whereby the deflecting member and the container advance together through the filling region.

9. The apparatus of claim 3 wherein each deflecting member comprises a guide chute having a longitudinally extending wall and leading and trailing lateral walls extending transversely through said continuous sheet of liquid, the upper edge of one of said lateral walls being formed with a lip which extends over and covers the upper edge of the corresponding other lateral wall of an adjacent deflecting member.

10. The apparatus of claim 9 wherein said one lateral wall is the trailing lateral wall of the guide chute.

11. The apparatus of claim 9 or 10 wherein the longitudinally extending wall of each deflecting member has a substantially horizontal upper edge, and the trailing lateral wall is substantially perpendicular to said horizontal edge.

12. The apparatus of claim 9 wherein each deflecting member comprises an additional longitudinally extending wall parallel and spaced from the first mentioned longitudinally extending wall to form said guide chute into an enclosed funnel.

* * * * *

UNITED STATES PATENT AND TRADEMARK OFFICE

CERTIFICATE OF CORRECTION

PATENT NO. : 4,349,053

DATED : September 14, 1982

INVENTOR(S) : Bernard C. Eisenberg

It is certified that error appears in the above-identified patent and that said Letters Patent are hereby corrected as shown below:

Column 1, line 51, delete "to" and insert --of--

Signed and Sealed this

First Day of February 1983

[SEAL]

*Attest:*

GERALD J. MOSSINGHOFF

*Attesting Officer*

*Commissioner of Patents and Trademarks*